US009422745B2

(12) United States Patent
Chow

(10) Patent No.: US 9,422,745 B2
(45) Date of Patent: Aug. 23, 2016

(54) SAFE WITH NITINOL WIRE LOCKING MECHANISM

(71) Applicant: Leslie Ho Leung Chow, Shilouzhen Panyu District (CN)

(72) Inventor: Leslie Ho Leung Chow, Shilouzhen Panyu District (CN)

( * ) Notice: Subject to any disclaimer, the term of this patent is extended or adjusted under 35 U.S.C. 154(b) by 0 days.

(21) Appl. No.: 14/273,769

(22) Filed: May 9, 2014

(65) Prior Publication Data

US 2015/0322695 A1 Nov. 12, 2015

(51) Int. Cl.

| | |
|---|---|
| ***E04G 1/04*** | (2006.01) |
| ***E05B 47/00*** | (2006.01) |
| ***E05G 1/02*** | (2006.01) |
| ***E05G 1/10*** | (2006.01) |
| ***E05B 65/00*** | (2006.01) |
| ***E05B 49/00*** | (2006.01) |
| ***E05G 1/04*** | (2006.01) |
| *E05B 51/00* | (2006.01) |
| *E05B 47/06* | (2006.01) |
| *E05B 47/02* | (2006.01) |
| *E05G 1/00* | (2006.01) |

(52) U.S. Cl.

CPC ..... *E05B 47/00* (2013.01); *E05B 47/0009* (2013.01); *E05B 49/00* (2013.01); *E05B 51/00* (2013.01); *E05B 65/00* (2013.01); *E05B 65/0075* (2013.01); *E05B 65/0082* (2013.01); *E05G 1/02* (2013.01); *E05G 1/04* (2013.01); *E05G 1/10* (2013.01); *E05B 47/026* (2013.01); *E05B 47/06* (2013.01); *E05B 51/005* (2013.01); *E05G 1/00* (2013.01); *E05G 1/005* (2013.01); *E05G 2700/00* (2013.01); *Y10T 70/7068* (2015.04); *Y10T 70/7107* (2015.04)

(58) Field of Classification Search

CPC ..... E05G 1/005; E05G 1/026; E05G 1/04; E05G 1/024; E05G 1/00; E05G 1/02; E05G 1/10; E05G 1/08; E05G 1/06; E05G 2700/00; Y10T 70/5031; Y10T 70/7068; Y10T 70/7062; Y10T 70/7107; E05B 47/0012; E05B 47/0001; E05B 47/0603; E05B 47/068; E05B 47/026; E05B 47/06; E05B 47/00; E05B 47/0009; E05B 49/00; E05B 51/00; E05B 51/005; E05B 65/00; E05B 65/0075; E05B 65/0082

USPC ..... 70/63, 278.1, 278.3; 109/49, 50–52, 109/59 R–63, 64–66

See application file for complete search history.

(56) References Cited

U.S. PATENT DOCUMENTS

| | | | | | |
|---|---|---|---|---|---|
| 2,727,996 | A | * | 12/1955 | Rockwell, III et al. | 250/517.1 |
| 2,904,172 | A | * | 9/1959 | Welch | 70/456 R |
| 3,726,238 | A | * | 4/1973 | Gordon | 109/2 |
| 3,895,150 | A | * | 7/1975 | King et al. | 428/99 |
| 3,967,478 | A | * | 7/1976 | Guinn | 70/144 |

(Continued)

*Primary Examiner* — Suzanne Barrett
*Assistant Examiner* — Morgan McClure
(74) *Attorney, Agent, or Firm* — John R. Ross; John R. Ross, III

(57) ABSTRACT

A safe. A safe lid is connected to a safe box via a hinge attachment. The safe is locked shut by utilization of a latch assembly. A Nitinol wire is connected to a latch assembly opening device. The latch assembly opening device is connected to the latch assembly. A user can open the safe by inputting the correct pass code into a keypad. An electrical signal is then transferred to the Nitinol wire causing the Nitinol wire to shorten. The shortening of the Nitinol wire causes the latch assembly opening device to open the latch assembly. In a preferred embodiment a key lock is also configured to control the latch assembly opening device and the key lock may be used as another method to open the safe.

8 Claims, 11 Drawing Sheets

(56) References Cited

U.S. PATENT DOCUMENTS

| | | | | | |
|---|---|---|---|---|---|
| 4,236,463 | A * | 12/1980 | Westcott | 109/33 |
| 4,722,435 | A * | 2/1988 | Mareels et al. | 206/1.5 |
| 5,389,919 | A * | 2/1995 | Warren et al. | 340/5.31 |
| 5,669,110 | A * | 9/1997 | Parsons | 24/16 PB |
| 5,701,828 | A * | 12/1997 | Benore et al. | 109/56 |
| 5,774,058 | A * | 6/1998 | Henry et al. | 340/5.5 |
| 5,778,805 | A * | 7/1998 | Green | 109/51 |
| 5,887,467 | A * | 3/1999 | Butterweck et al. | 70/278.7 |
| 5,897,625 | A * | 4/1999 | Gustin et al. | 705/43 |
| 5,905,446 | A * | 5/1999 | Benore et al. | 340/5.7 |
| 6,008,992 | A * | 12/1999 | Kawakami | 361/726 |
| 6,082,153 | A * | 7/2000 | Schoell et al. | 70/1.5 |
| 6,098,433 | A * | 8/2000 | Maniaci | 70/278.1 |
| 6,101,682 | A * | 8/2000 | Parsons | 24/16 PB |
| 6,164,219 | A * | 12/2000 | Green | 109/73 |
| 6,209,367 | B1 * | 4/2001 | Hyatt et al. | 70/278.2 |
| 6,219,887 | B1 * | 4/2001 | Parsons | 24/16 PB |
| 6,318,137 | B1 * | 11/2001 | Chaum | 70/278.3 |
| 6,363,867 | B1 * | 4/2002 | Tsilevich | 109/49.5 |
| 6,485,081 | B1 * | 11/2002 | Bingle et al. | 296/76 |
| 6,500,092 | B2 * | 12/2002 | Syamoto | 477/99 |
| 6,508,437 | B1 * | 1/2003 | Davis et al. | 244/173.2 |
| 6,588,243 | B1 * | 7/2003 | Hyatt et al. | 70/278.2 |
| 6,692,056 | B2 * | 2/2004 | Bingle et al. | 296/76 |
| 6,752,092 | B2 * | 6/2004 | Beattie et al. | 109/75 |
| 6,783,167 | B2 * | 8/2004 | Bingle et al. | 296/76 |
| 7,183,903 | B2 * | 2/2007 | Nicolson et al. | 340/426.36 |
| 7,690,231 | B1 * | 4/2010 | Field et al. | 70/283 |
| 7,833,451 | B2 * | 11/2010 | Eiha et al. | 264/230 |
| 7,878,389 | B2 * | 2/2011 | Rudduck et al. | 232/44 |
| 8,006,607 | B2 * | 8/2011 | Wickert et al. | 89/36.17 |
| 8,474,386 | B2 * | 7/2013 | DelloRusso, Jr. | 109/80 |
| 2002/0170473 | A1 * | 11/2002 | Fettis et al. | 109/23 |
| 2003/0177974 | A1 * | 9/2003 | Dominique | 116/200 |
| 2004/0031301 | A1 * | 2/2004 | Dominique | 70/237 |
| 2005/0206175 | A1 * | 9/2005 | Browne et al. | 292/253 |
| 2008/0127684 | A1 * | 6/2008 | Rudduck et al. | 70/77 |
| 2009/0229321 | A1 * | 9/2009 | Eccles et al. | 70/93 |
| 2014/0083338 | A1 * | 3/2014 | McAlexander | 109/52 |
| 2014/0318200 | A1 * | 10/2014 | Ellis et al. | 70/465 |
| 2014/0338409 | A1 * | 11/2014 | Kraus et al. | 70/278.1 |
| 2015/0089980 | A1 * | 4/2015 | Maguire et al. | 70/101 |

* cited by examiner

SAFE WITH NITINOL WIRE LOCKING MECHANISM

BACKGROUND OF THE INVENTION

Safe boxes (also known as "safes") are well known in the prior art. They are used primarily to protect documents, currency, jewelry, and other valuables from fire and theft. Stand alone safes are very common in homes and businesses throughout the world. A fire-resistant safe (also known as a "fire safe") is a type of safe that is designed to protect its contents from high temperatures or actual fire. There are various types of locking mechanisms currently being utilized for safes that incorporate known technologies.

Nitinol Wire

Nitinol Wire (also known as 'Muscle Wire' or 'Memory Wire') is a thin strand of a special shape memory alloy composed primarily of Nickel (Ni) and Titanium (Ti). Nitinol Wire will shorten in length after receiving an electrical signal, or heated by other means. Nitinol wire returns to its original length the electrical signal is removed and/or cooled.

What is needed is a better safe that allows operation through a user controlled keypad as well as a backup operation via a hand held key.

SUMMARY OF THE INVENTION

The present invention provides a safe. A safe lid is connected to a safe box via a hinge attachment. The safe is locked shut by utilization of a latch assembly. A Nitinol wire is connected to a latch assembly opening device. The latch assembly opening device is connected to the latch assembly. A user can open the safe by inputting the correct pass code into a keypad. An electrical signal is then transferred to the Nitinol wire causing the Nitinol wire to shorten. The shortening of the Nitinol wire causes the latch assembly opening device to open the latch assembly. In a preferred embodiment a key lock is also configured to control the latch assembly opening device and the key lock may be used as another method to open the safe.

BRIEF DESCRIPTION OF THE DRAWINGS

FIGS. 3A-4C show the internal features of a preferred safe.

DETAILED DESCRIPTION OF THE PREFERRED EMBODIMENTS

Figure 1:
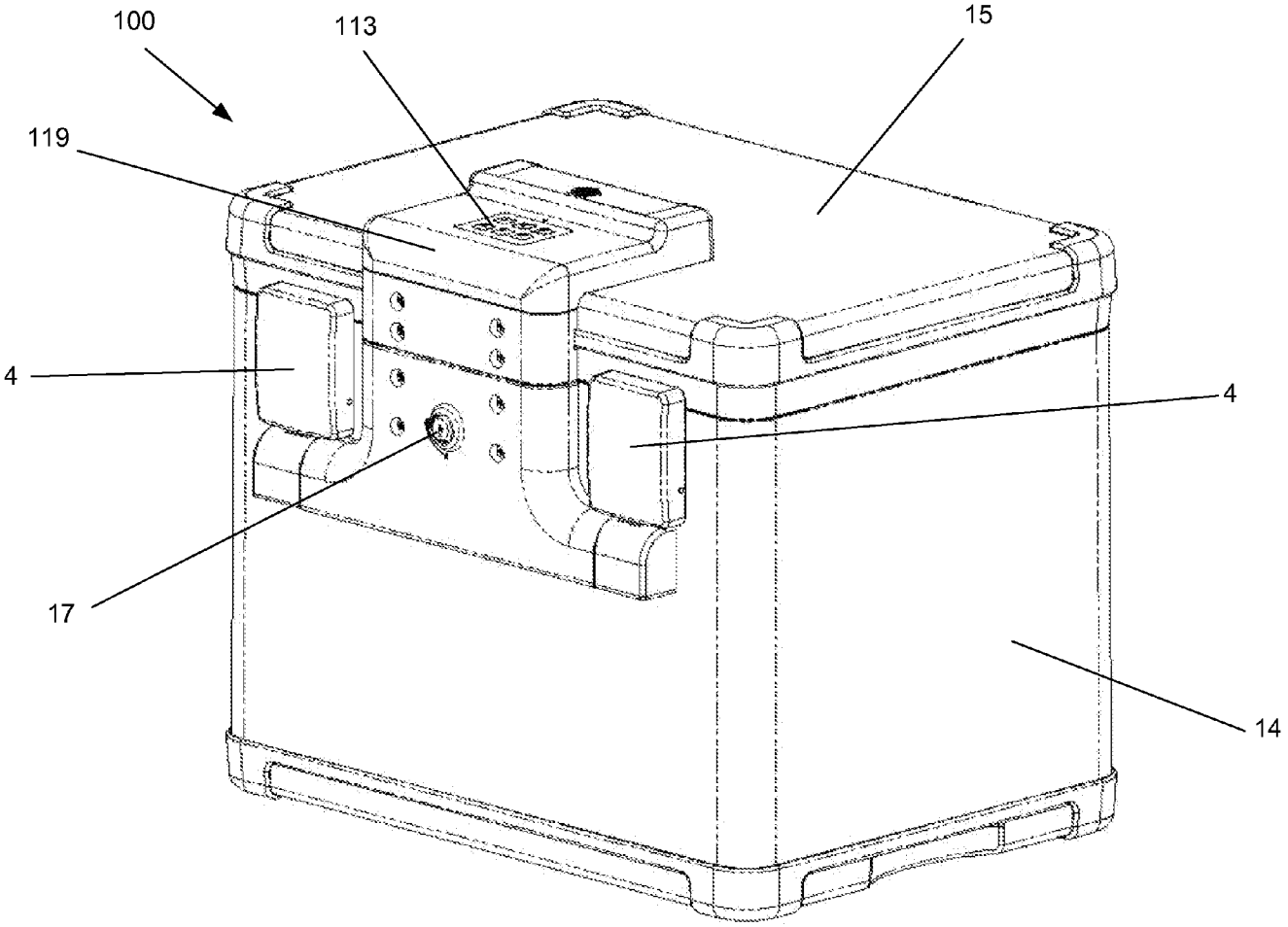
FIG. 1 shows a perspective view of a preferred safe.

FIG. 1 shows digital fire safe 100 having lid 15 and box 14. Lid 15 is connected to box 14 via hinges 135. When digital fire safe 100 is closed, the safe is locked by the latch assembly 4. The safe can only be opened after latch assembly 4 is released from the lid 15. When emergency key lock 17 is under the lock position, latch assembly 4 can be released automatically by utilizing keypad 113. As an alternative or in an emergency, safe 100 can be opened by utilizing key lock 17. Hence, key lock 17 can then be used as a second or backup method for opening the safe.

Figure 2A:
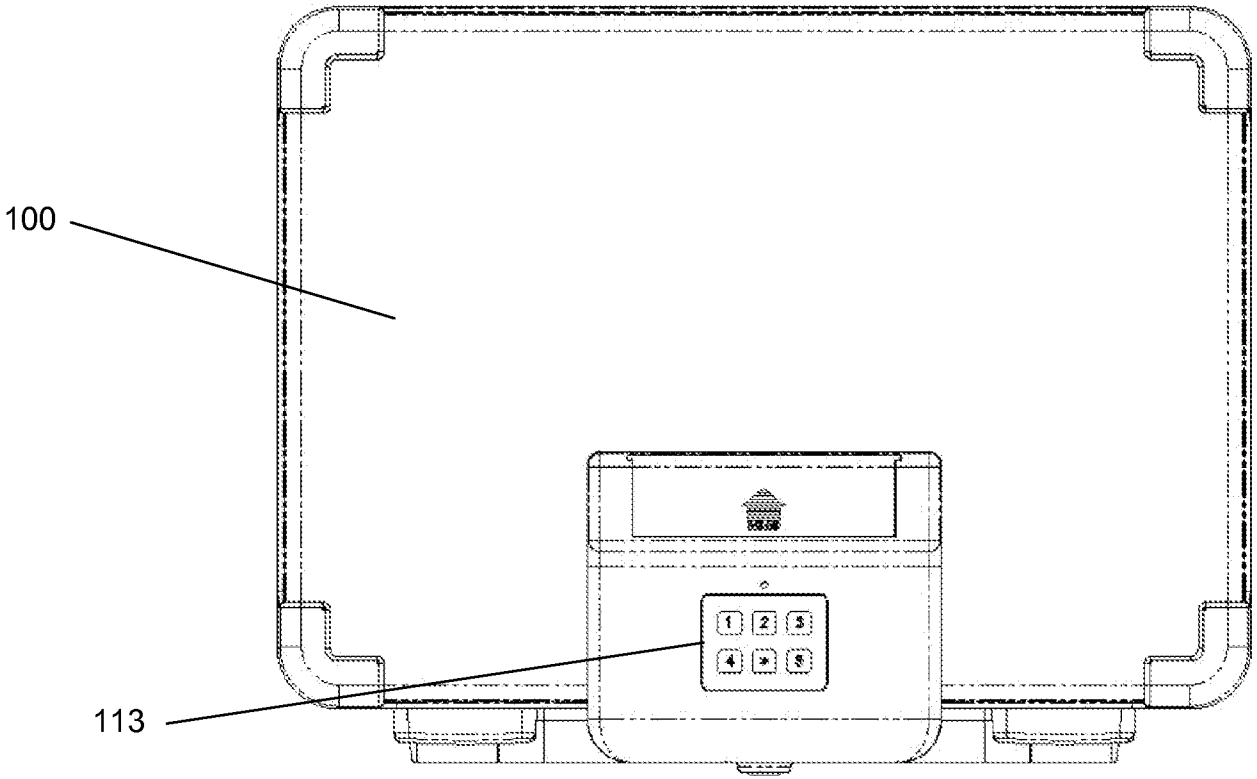
FIG. 2A shows a top view of a preferred safe.
Figure 2B:
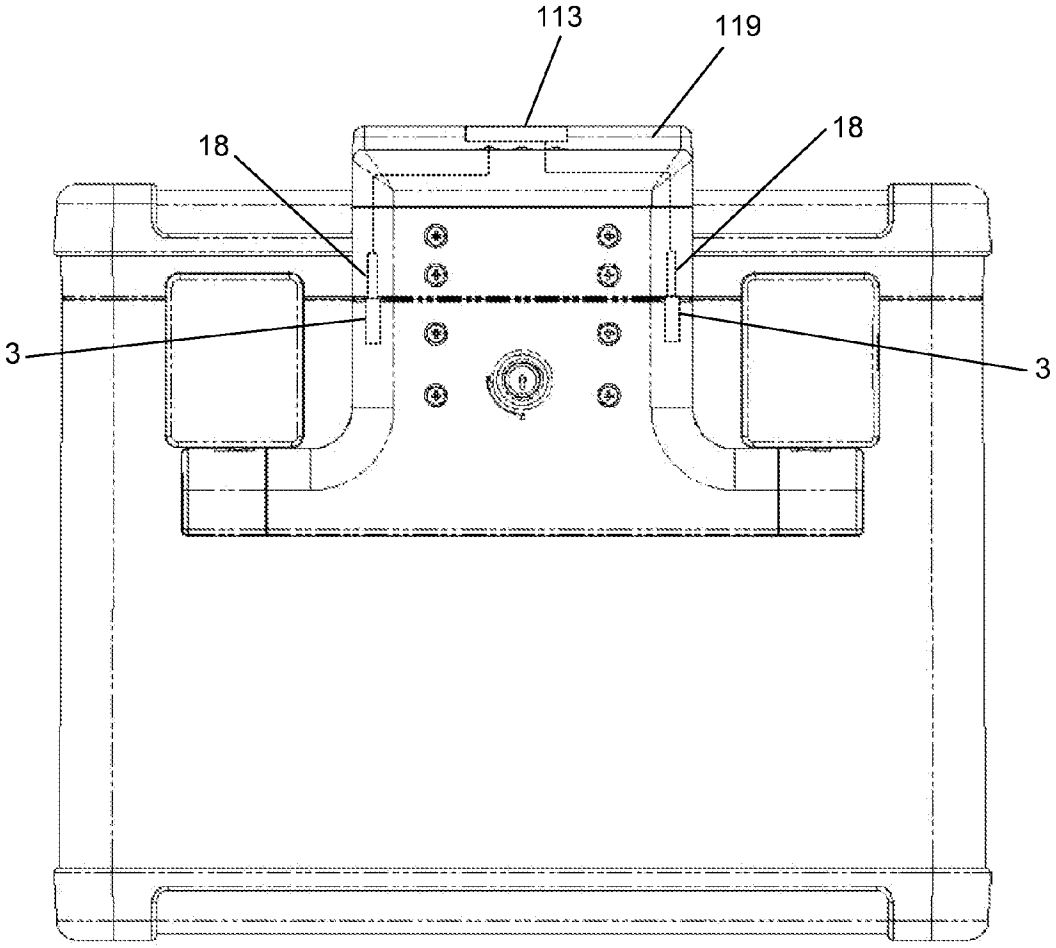
FIG. 2B shows a front view of a preferred safe.
Figures 3A, 3B, 3C, 3D:
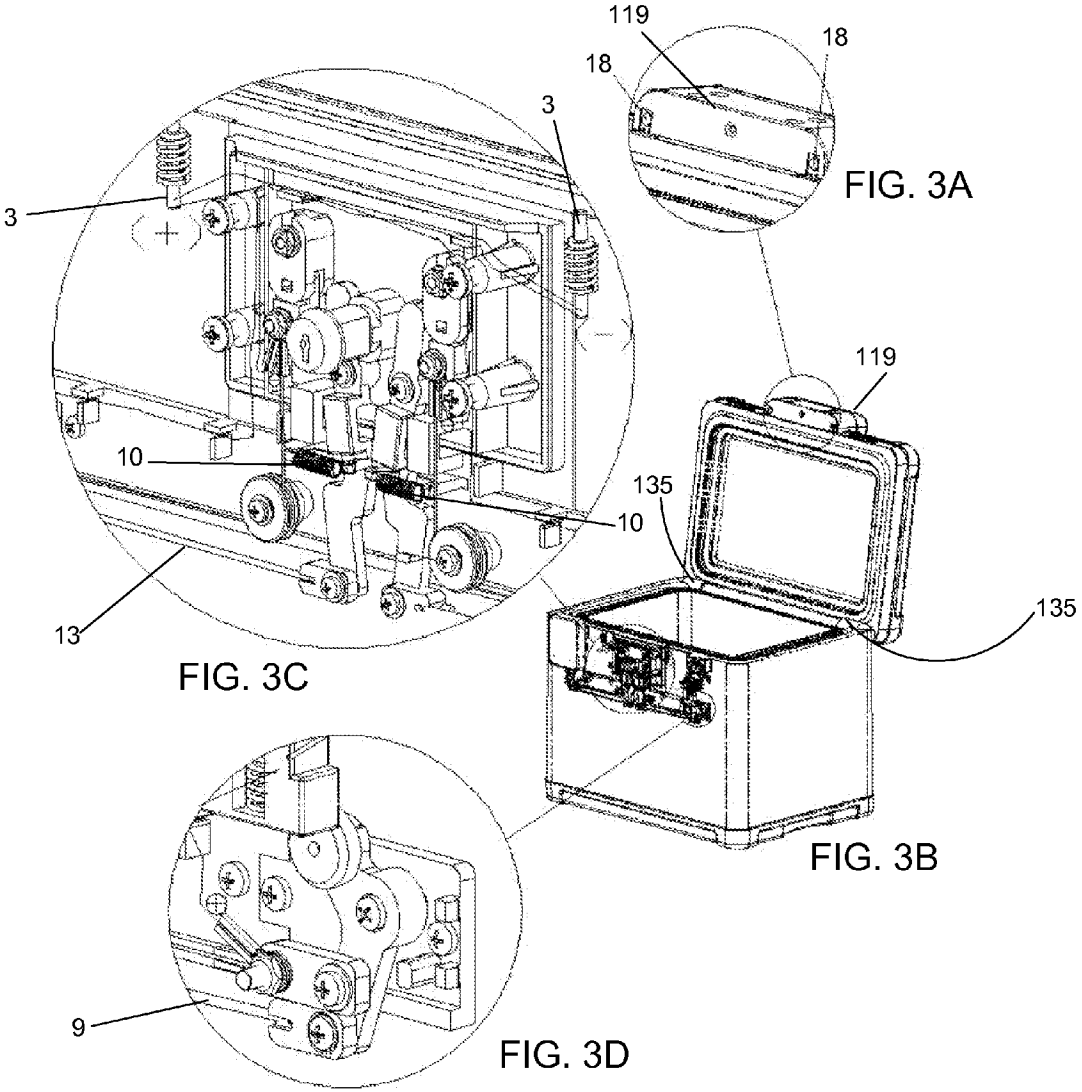
Figures 4A, 4B, 4C:
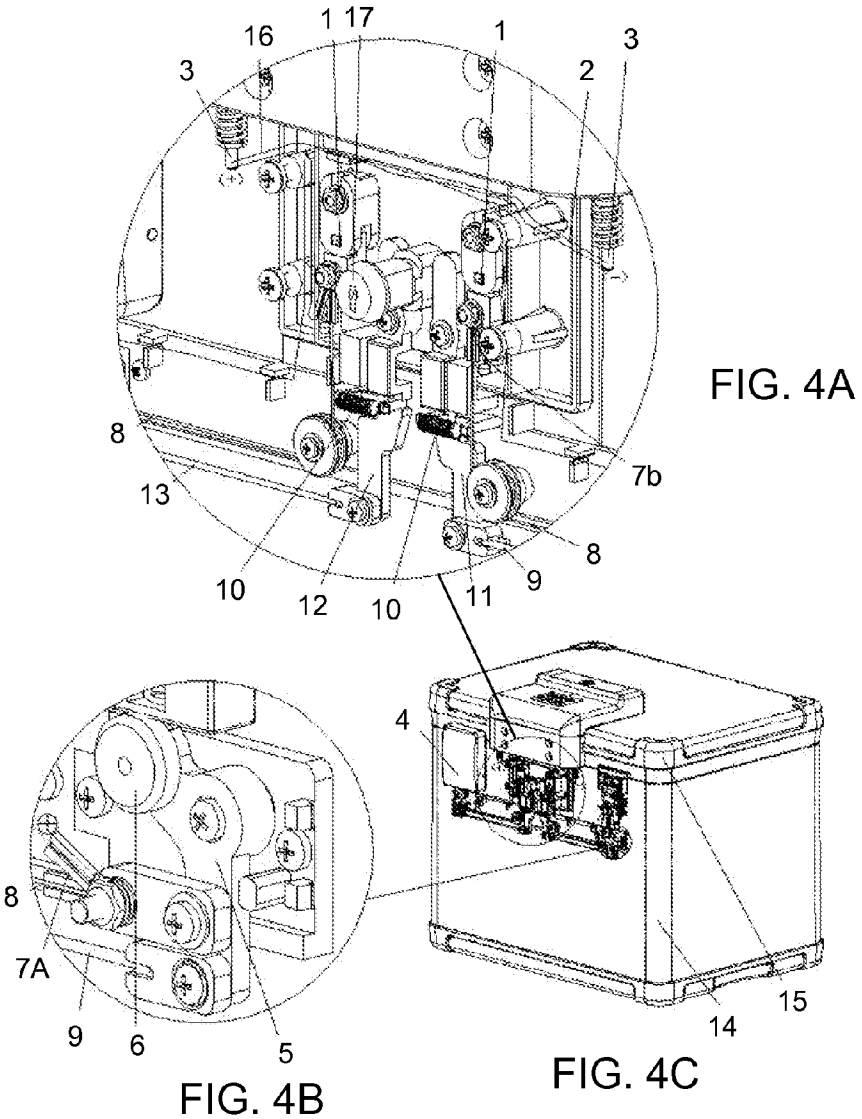
Figure 5A:
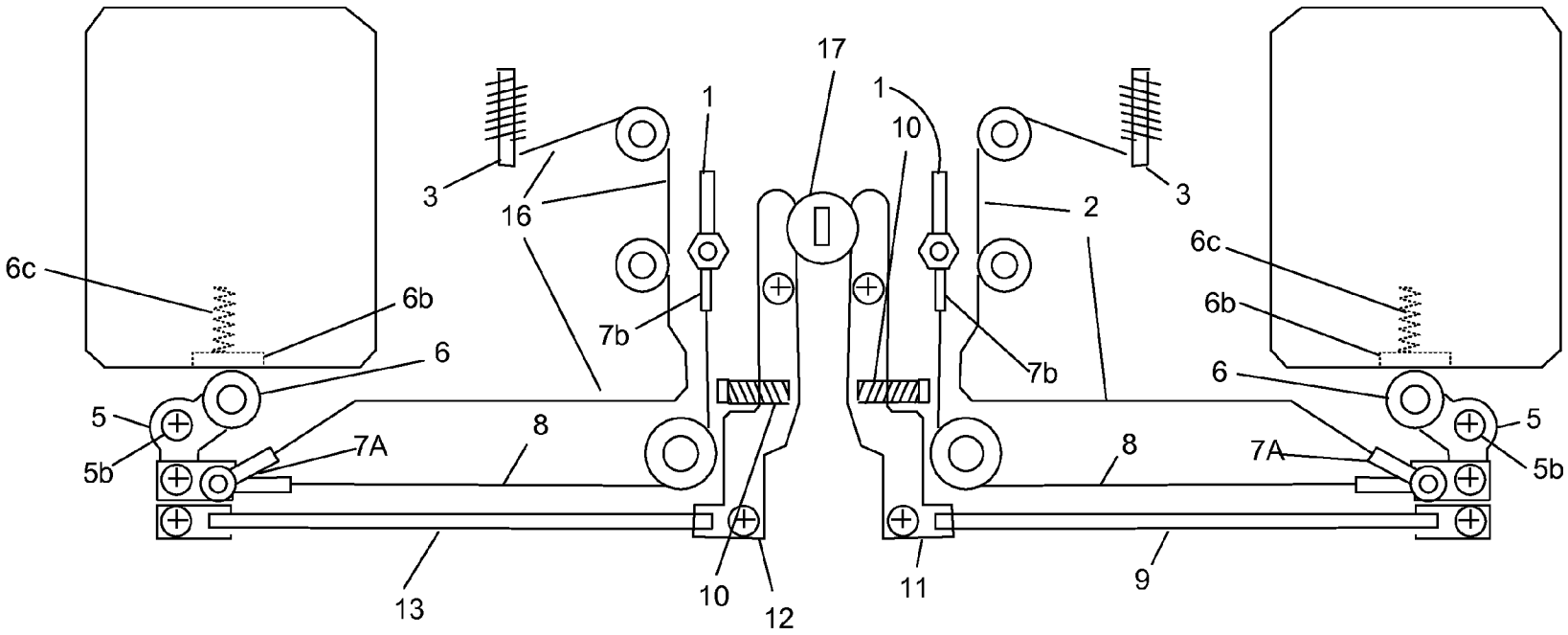
FIGS. 5A-5E show illustrate the locking mechanism of a preferred safe.
Figure 5B:
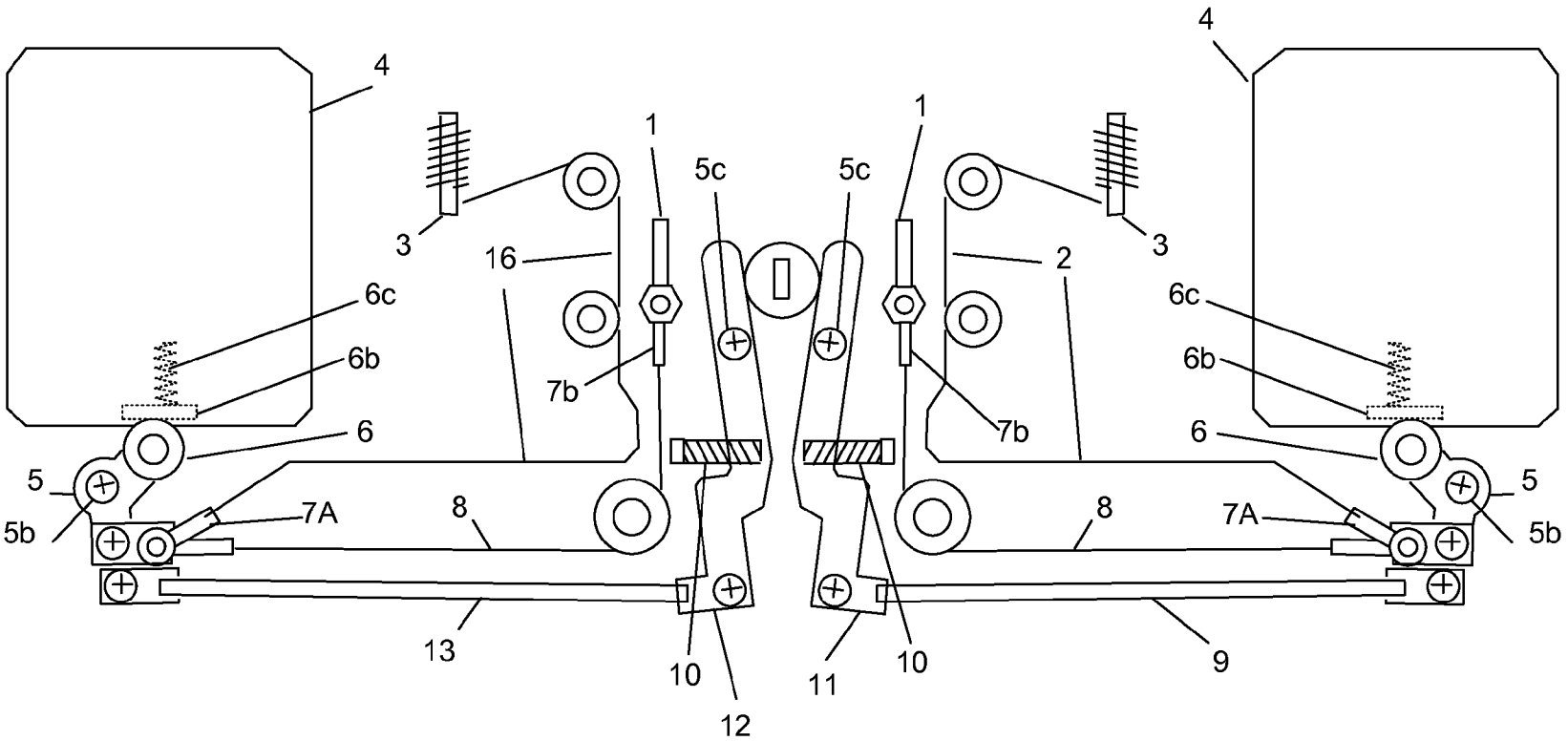
Figure 5C:
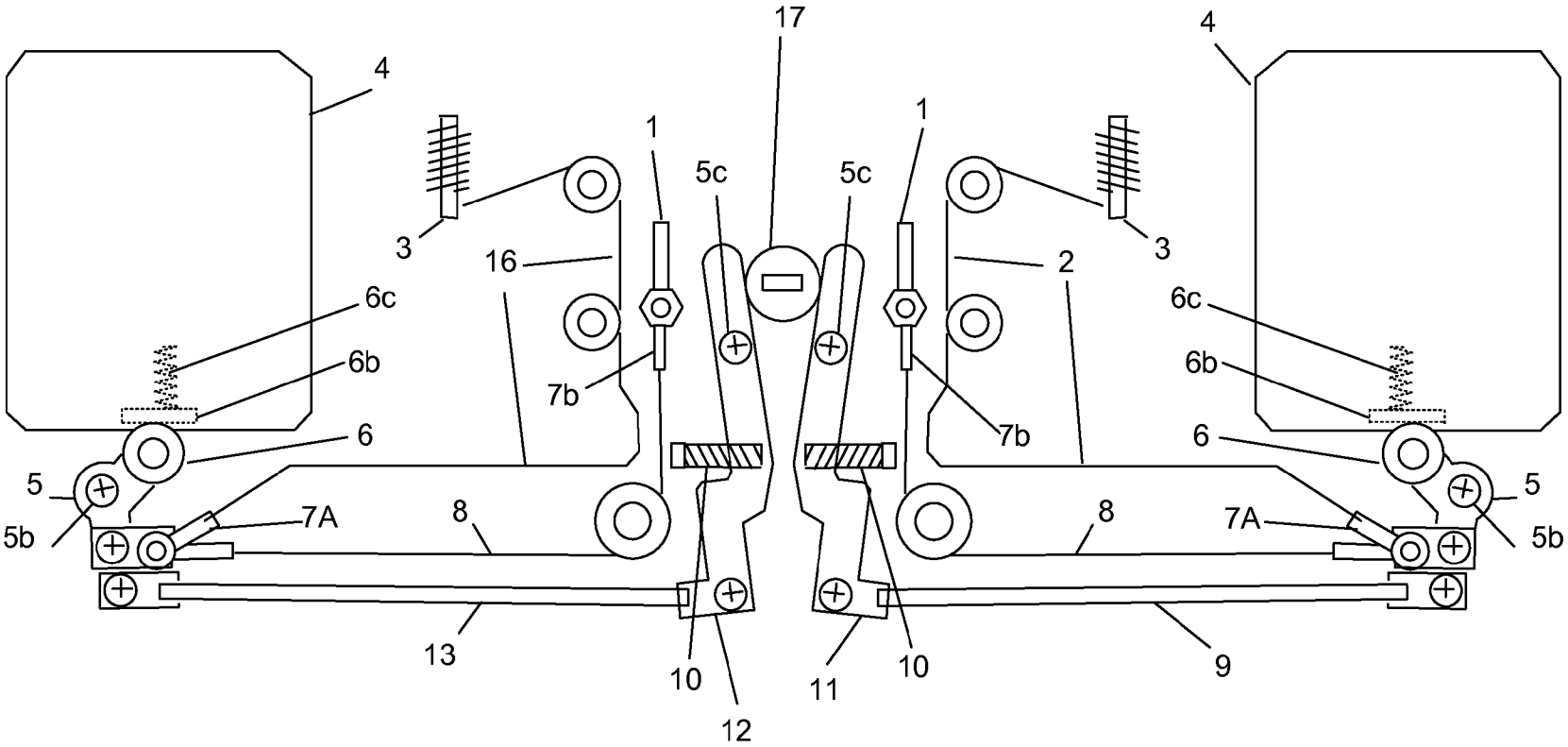
Figure 5E:
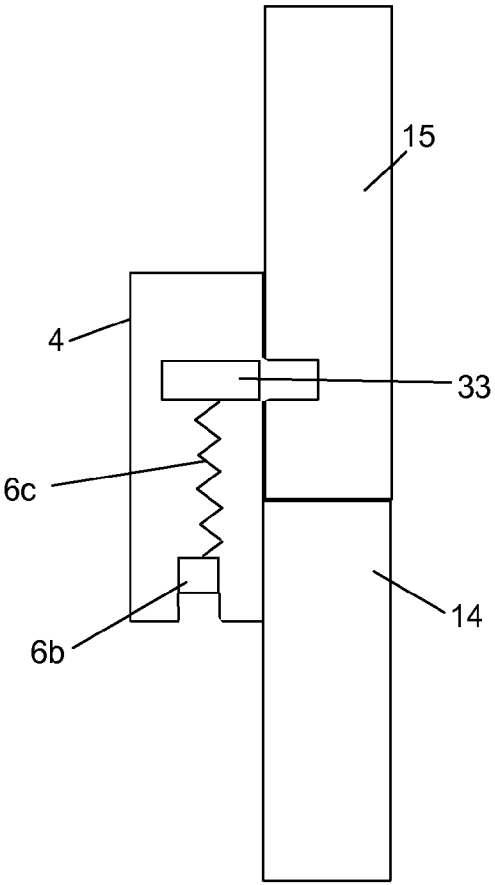
Figure 5D:
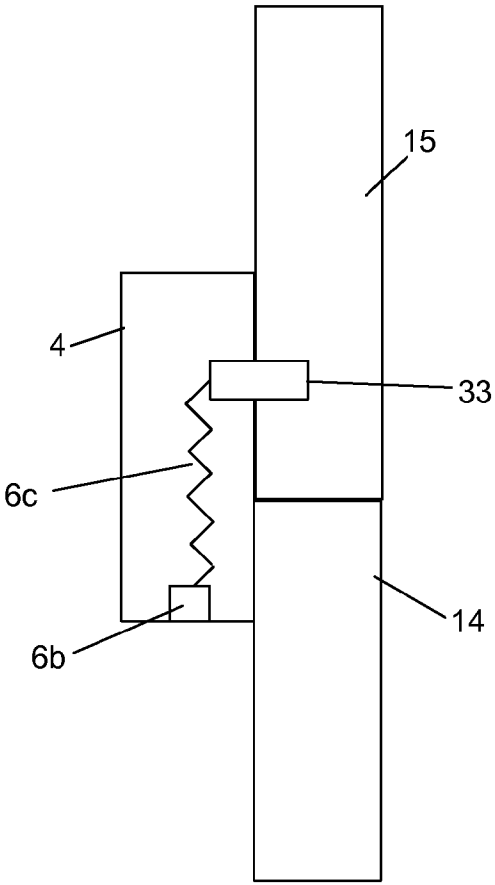

Key pad 113 allows safe 100 to be opened without the use of a key. When the correct passcode is entered via keypad 113 (see also FIGS. 2A, 2B), a 3V electrical signal is transmitted from keypad 113 through electrode plates 18 to electrode rods 3 (FIGS. 2B, 3A). Electrode plates 18 extend downward through front cover 119 (FIG. 3A). The electrical signal passes through electrode plates 18 to electrode rods 3, which then passes the electrical signal through the positive terminal wire 16 and negative terminal wire 2 to crimps 7A (FIG. 5A) that are attached to Nitinol wires 8 (see also FIGS. 4A-4B). When a current passes through Nitinol wire 8, the length shortens, pulling on rotatable push plates 5 and causing them to turn (FIG. 5B). Rotatable push plates 5 function as a latch assembly opening mechanism. As rotatable push plates 5 turn, wheels 6 move upwards, pushing onto the latch buttons 6*b*, which activates internal spring mechanism 6*c*. Locking tab 33 is then pulled clear of lid 15 thereby releasing latch assembly 4 from lid 15 (FIGS. 3A-5E).

When Nitinol wire 8 shortens, it pulls on the rotatable push plates 5. Simultaneously, push rods 9 and 13 push the bottom half of lock levers 11 and 12 to move against the center, causing a tension on lock lever springs 10 (FIGS. 5B and 3C).

The electrical signal is transmitted for approximately 3 seconds. After 3 seconds, Nitinol wire 8 lengthens and returns back to its original length. At this time, the lock lever springs 10 pull lock levers 11 and 12. Lock lever springs 10 function as a This action moves push rods 9 and 13 causing the rotatable push plates 5 to turn to their original positions while pulling wheel 6 back to its original position, as shown in FIG. 5A.

Figures 6A, 6B, 6C:
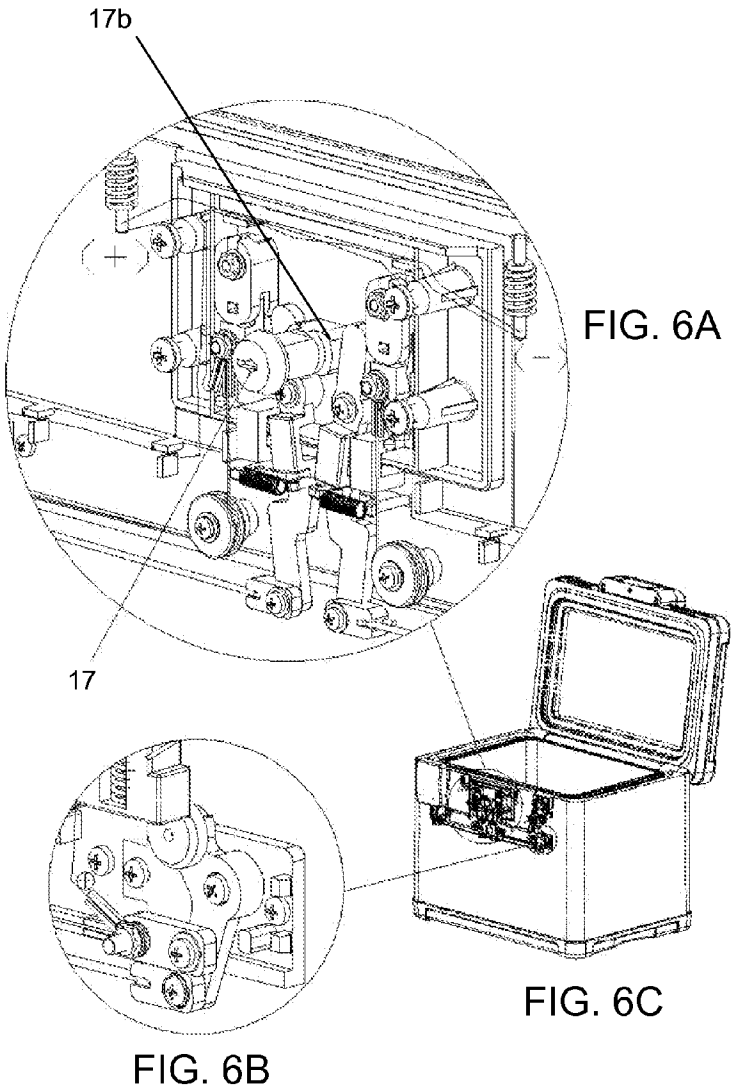
FIGS. 6A-6C show the function of the key lock.

Using a key to turn key lock 17 (FIG. 5C), the top part of lock levers 11 and 12 is pushed apart by mechanism 17*b* (see also FIGS. 6A-6C). This action pulls push rods 9 and 13, which push wheels 6 to move upwards, pushing onto the latch buttons 6*b*, which activates internal spring mechanism 6*c* of latch assembly 4, releasing it latch assembly 4 from lid 15 (FIGS. 5A and 4C).

When environmental temperature reaches 75° C., low melt metal rod 1 (FIGS. 4A, 5A, 5B) melts and Nitinol wire 8 loses an anchor point, causing it to have no pulling force to push the wheels 6 to push onto latch buttons 6*b* to release the latch assembly 4. After low melt metal rod 1 has melted, key pad 113 can no longer be used to open the safe.

Other Embodiments

Figure 7:
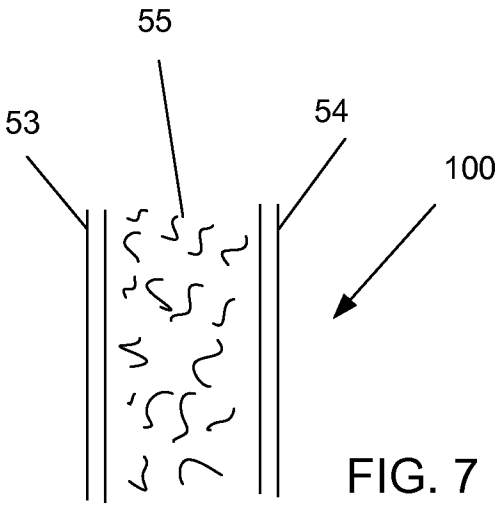
FIG. 7 shows a preferred fire safe.

FIG. 7 shows that safe 100 can be a fireproof safe. For example box 4 includes interior wall 54 and exterior wall 53 with fireproof insulation 55 between. To make safe 100 a fireproof safe, all walls of box 14 and lid 15 include insulation 53 sandwiched between interior and exterior walls. Also, it should be noted that safe 100 can be fabricated from either plastic or metal.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A safe comprising:

A. a box,

B. a lid connected to said box via a hinge,

C. two latch assemblies for locking said lid onto said box,

D. two latch assembly opening devices respectively connected to the two latch assemblies, E. two electronic circuits each comprising one Nitinol wire each connected to one of the latch assembly opening devices, wherein said two Nitinol wires shorten after receiving said electronic signal causing said latch assembly opening devices to move from their original positions and to open said two latch assemblies to release said lid from said box so that said safe can be opened, F. a user controllable keypad connected to said electronic circuit for allowing a user to transmit an electronic signal to said two Nitinol wires, G. a user controlled key lock, two lock levers, two push rods, two rotatable push plates, two internal spring mechanisms, a key mechanism and a key which when the key is turned to an unlocked position a top portion of the two lock levers are pushed apart by the key mechanism causing the two lock levers to pull the two push rods to push the two rotatable push plates causing the activation of the two internal spring mechanisms to release the two latch assemblies from the lid.

2. The safe as in claim 1, further comprising a low melt metal rod connected to said at least one Nitinol wire so that said Nitinol wire will lose its anchor after said low melt metal rod has melted.

3. The safe as in claim 1, wherein said safe is a fire safe.

4. A safe comprising:

A. a box,

B. a lid connected to said box via a hinge,

C. a latch assembly for locking said lid onto said box,

D. an electronic circuit comprising at least one Nitinol wire, said electronic circuit comprising:

i. a user controllable keypad, ii. an electrode plate connected to said keypad iii. an electrode rod removably connected to said electrode plate, iv. an electrical connection wire connected to said electrode rod, v. a Nitinol wire connected to said electrical connection wire, E. a latch assembly opening device connected to said latch assembly, said latch assembly opening device comprising:

i. a rotatable push plate connected to said Nitinol wire, ii. a push rod connected to said rotatable push plate, iii. a lock lever connected to said push rod, iv. a lock lever spring anchored to said safe and connected to said lock lever, wherein said at least one Nitinol wire shortens after receiving said electronic signal causing said latch assembly opening device to move from its original position and to open said latch assembly to release said lid from said box so that said safe can be opened, F. a user controlled key lock, two lock levers, two push rods, two rotatable push plates, two internal spring mechanisms, a key mechanism and a key which when the key is turned to an unlocked position a top portion of the two lock levers are pushed apart by the key mechanism causing the two lock levers to pull the two push rods to push the two rotatable push plates causing the activation of the internal spring mechanisms to release the latch assembly from the lid.

5. The safe as in claim 4 wherein said lock lever spring returns said latch assembly opening device to its original position.

6. The safe as in claim 5, wherein said lock lever spring is two lock lever springs.

7. The safe as in claim 4, further comprising a low melt metal rod connected to said at least one Nitinol wire so that said Nitinol wire will lose its anchor after said low melt metal rod has melted.

8. The safe as in claim 4, wherein said safe is a fire safe.

* * * * *